US009179752B2

(12) United States Patent
Kim et al.

(10) Patent No.: US 9,179,752 B2
(45) Date of Patent: Nov. 10, 2015

(54) COSMETIC BOX WITH FAN AND NAIL DRYING APPARATUS

(71) Applicants: In Kyung Kim, Los Angeles, CA (US); Mitchell Won, Los Angeles, CA (US)

(72) Inventors: In Kyung Kim, Los Angeles, CA (US); Mitchell Won, Los Angeles, CA (US)

( * ) Notice: Subject to any disclaimer, the term of this patent is extended or adjusted under 35 U.S.C. 154(b) by 0 days.

(21) Appl. No.: 14/312,226

(22) Filed: Jun. 23, 2014

(65) Prior Publication Data

US 2014/0300259 A1 Oct. 9, 2014

(51) Int. Cl.

| | |
|---|---|
| ***A45D 29/18*** | (2006.01) |
| ***A45D 29/00*** | (2006.01) |
| ***A45C 5/00*** | (2006.01) |
| ***A45C 5/06*** | (2006.01) |
| ***A45C 9/00*** | (2006.01) |
| ***A45C 15/00*** | (2006.01) |
| ***A45C 15/04*** | (2006.01) |
| ***A45C 15/06*** | (2006.01) |

(52) U.S. Cl.

CPC ..... *A45D 29/00* (2013.01); *A45C 5/005* (2013.01); *A45C 5/065* (2013.01); *A45C 9/00* (2013.01); *A45C 15/00* (2013.01); *A45C 15/04* (2013.01); *A45C 15/06* (2013.01); *A45D 2200/205* (2013.01)

(58) Field of Classification Search

CPC ..... A45D 29/20; A45D 33/008; A45D 33/08; A45D 33/16; A45D 33/20; A45D 33/22; A45D 33/32; A45D 42/08; A45D 42/16

IPC ..... A45D 29/30

See application file for complete search history.

(56) References Cited

U.S. PATENT DOCUMENTS

| | | | | |
|---|---|---|---|---|
| 1,667,564 | A * | 4/1928 | Pearson | 312/201 |
| 3,864,847 | A | 2/1975 | Friedman | |
| 4,754,769 | A | 7/1988 | Flynn | |
| 4,979,523 | A * | 12/1990 | Grimm | 132/73.5 |
| 5,090,300 | A | 2/1992 | Berenstein | |
| 8,128,245 | B2 | 3/2012 | Limjoco | |
| 2004/0089584 | A1 * | 5/2004 | Zadro | 206/581 |
| 2006/0077654 | A1 * | 4/2006 | Krieger et al. | 362/136 |
| 2010/0200009 | A1 * | 8/2010 | Trueax et al. | 132/73.5 |

* cited by examiner

*Primary Examiner* — Rachel Steitz

(74) *Attorney, Agent, or Firm* — Scot S. Fagerland, Esq.

(57) ABSTRACT

We disclose a cosmetic box inspired by the traditional Asian design. The box comes equipped with electrical apparatus for drying and sterilizing make-up. A fan is mounted within the box. When the drawers are ajar, the fan blows air toward the user's face and hair. When the drawers are removed, the user may insert her hands into the drawer cavity to dry her nail polish. Ultra-violet light bulbs are also mounted within the box. The bulbs assist in the sterilization of nail polish as well as the contents of the box.

5 Claims, 9 Drawing Sheets

COSMETIC BOX WITH FAN AND NAIL DRYING APPARATUS

1. FIELD OF THE INVENTION

This invention is in the field of cosmetics, specifically apparatus for drying makeup.

2. BACKGROUND AND OBJECTS OF THE INVENTION

A traditional style of cosmetic box is well-known in Asian countries such as China, Japan, and Korea. It is about the size of a small tool box. During storage or travel, the structure looks like a small chest with pull-out drawers. It is used to hold makeup, makeup paraphernalia, jewelry, and the like. When the lid is opened, it reveals a mirror on its underside. The mirror is propped up against a lip on the front of the jewelry box. The woman using the product then has easy access to her makeup and a mirror at the same time.

When applying makeup, it is often convenient to have a fan. The fan can keep the makeup dry so it does not smear, and so multiple layers can be applied more quickly. While applying facial makeup one day, I realized that I was constantly turning back and forth between my mirror and my fan. I recognized the need for a fan and mirror combined in one unit.

The nail dryer is a device commonly found in salons. It is sometimes sold as a household product as well. After applying nail polish, a woman rests her hands in a nail dryer. It can dry her nails with heated elements, circulating air, and/or ultra-violet (UV) light.

The present invention is a novel combination of the Asian-style cosmetic box with a fan that can be applied to the face or nails. The box also features ultra-violet lights to aid in drying nail polish. The makeup drawer may be entirely removed for easy insertion of hands. The UV lights may remain on when the drawer is in the box, for the purpose of sterilizing nail files, makeup brushes, or other similar paraphernalia.

3. DESCRIPTION OF RELATED TECHNOLOGY

The traditional Asian cosmetic box and the generic nail dryer are discussed separately above.

U.S. Pat. No. 8,128,245, "Make-up Mirror With Air Flow Component" (invented by Lisa Limjoco) discloses a combination of mirror with fan for drying facial makeup. Limjoco installs a fan behind a circular mirror. Air comes through vents ("apertures") in the housing ("base component") of the product, encircling the mirror. The air is directed at the user's face. The Limjoco patent claims some particular features that are not descriptive of my device, such as a circular shape and two pivot apertures securing the mirror to its stand.

In U.S. Pat. No. 3,864,847, Fred and Gertrude Friedman disclosed a nail dryer with a horizontally disposed tray free to move forwardly or rearwardly. When not in use, the tray would be in the "forward" position, extending outward from the dryer. A user would rest her hand on the tray and slide it back into the dryer. When the tray was slid "backward" into the product, it would activate the electric drying apparatus. The Friedmans described their drying means as "heat sources" in claim 1 and more specifically as "conventional infra-red bulbs" in claim 2.

4. SUMMARY OF THE INVENTION

The starting point of the invention is a cosmetic box. In its best mode, the main body of the unit is fashioned after a "traditional Asian" cosmetic box as described above. During storage and travel, it takes the form of a rectangular prism. Historically, such boxes were made of wood, but they can be fashioned from metals or synthetic materials just as well. The lid of the box lifts up to reveal a rectangular mirror, which is hingedly attached to the underside of the lid. In its open position, the mirror is propped up, for example up against the top-front edge of the box. The box is essentially hollow. It includes one or more drawers that are used for makeup, makeup paraphernalia, and jewelry.

My first primary point of novelty is the inclusion of a fan inside the box. In the product's best mode, the fan is installed in the rear of the box, behind the drawer space. The fan serves two primary purposes. It can assist in drying nail polish, facial makeup, or hair products. For the purpose of drying her nails, the user removes a drawer and inserts her hands into the drawer cavity. The fan blows directly onto her nails.

To facilitate drying facial makeup or hair products, the airstream can be directed through the drawers when they are ajar. The rear face of each drawer is made of netting to allow air to flow through it. When the air strikes the front face of a drawer, it is redirected upward. This provides the convenience of a steady flow of air onto the user's face and hair while she looks into the mirror.

My second primary point of novelty is the use of ultra-violet (UV) light bulbs to further assist in the drying and hardening of nail polish. In the product's best mode, the UV light bulbs are affixed to the upper surface of the drawer cavity. The UV bulbs can be used in lieu of or simultaneously with the fan to dry and harden the user's nails. UV radiation is especially helpful for keeping the nails and nail polish sanitized. When the drawer is closed and full of makeup paraphernalia such as nail files and makeup brushes, the UV light may be turned on to sterilize those items too.

The product also includes the electric switches and motorized fan necessary to operate the fan and UV bulbs. To keep the product lightweight, I use a small motor and no heating elements.

5. BRIEF DESCRIPTION OF THE DRAWINGS

FIG. 1 is a perspective view of the box in closed position. The front face of the box, with the pull-out drawers, can be seen in this view. Interior features such as the fan, UV lights, and drawer netting, are shown with hidden lines.

FIG. 2 is a perspective view of the box in closed position. The rear face of the box, including the fan ventilation unit, can be seen in this view. Interior features are shown with hidden lines.

FIG. 3 is a perspective view of the box in open position. The mirror is propped up for use. The drawers are ajar.

FIG. 4 is a perspective view of the interior of the box with the drawer removed.

FIG. 5 demonstrates a woman using the box to dry her fingernails. At least one drawer is removed, and the user's hands are in the drawer cavity.

FIG. 6 is a front plan view of the box. Interior features are shown with hidden lines. This figure shows the optional feature of dividers to create compartments in the drawers and on the upper surface.

6. DETAILED DESCRIPTION OF THE PREFERRED EMBODIMENTS

Each feature of the invention is identified by a three-digit number. The first digit identifies the figure in which the feature is first or most clearly referred to.

Figure 1:
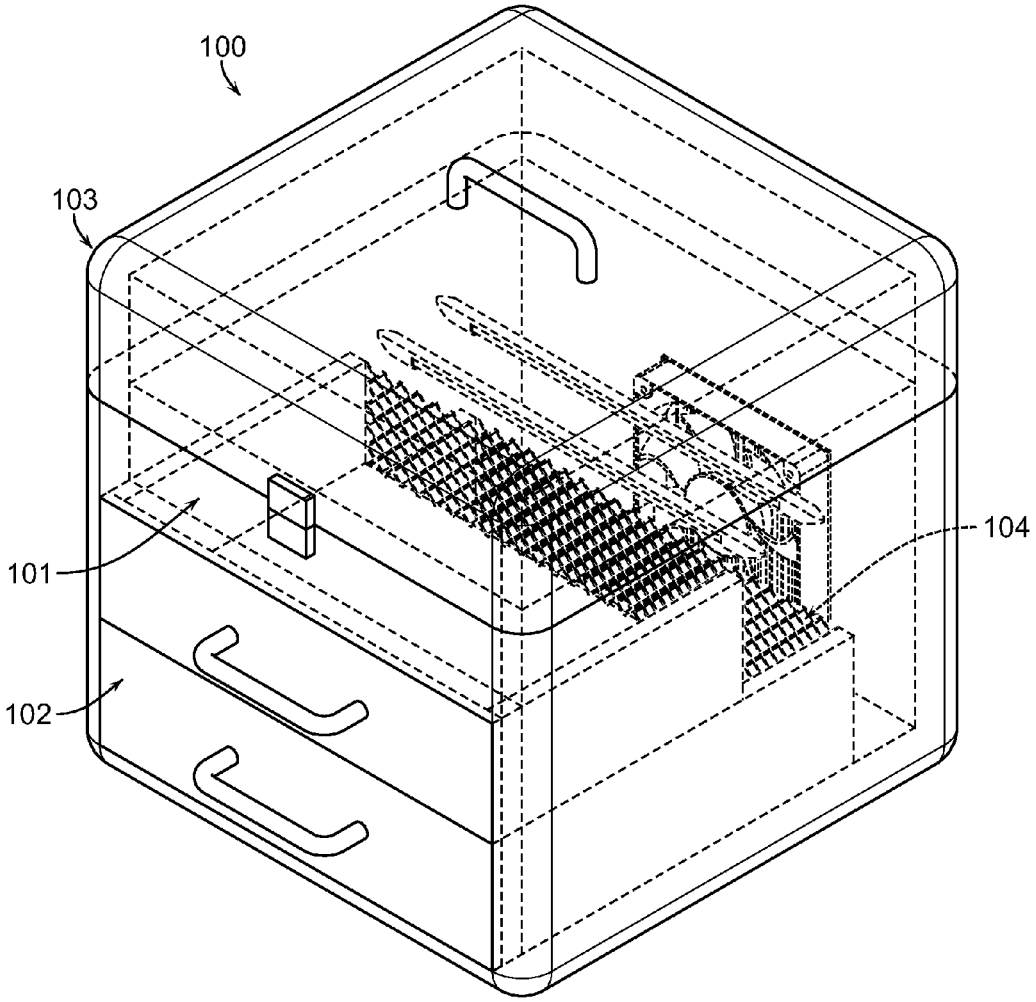

FIG. 1 shows an overview of the cosmetic box (100) including its interior features. FIG. 1 shows a clear view of the box's front face (101), one or more drawers (102) and the lid (103).

Figure 2:
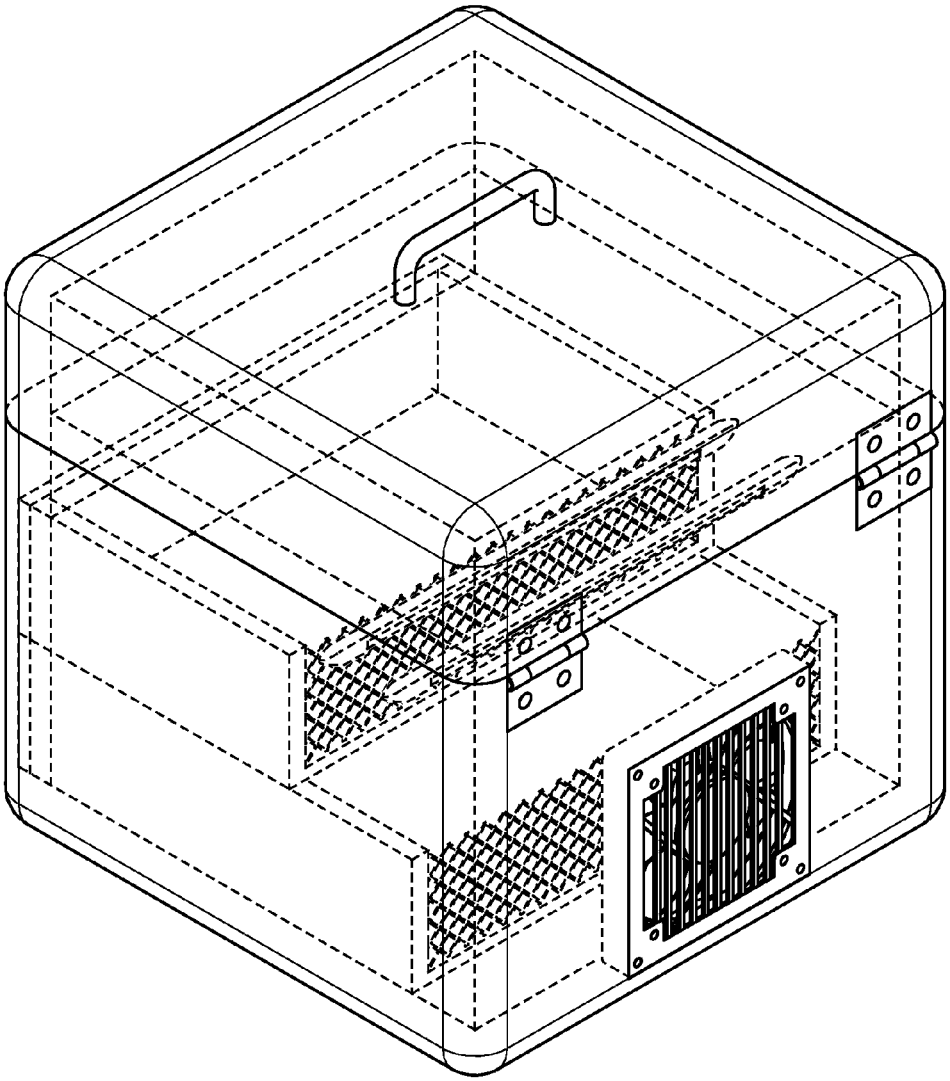

FIG. 2 shows an overview of the same features from the rear.

Figure 3:
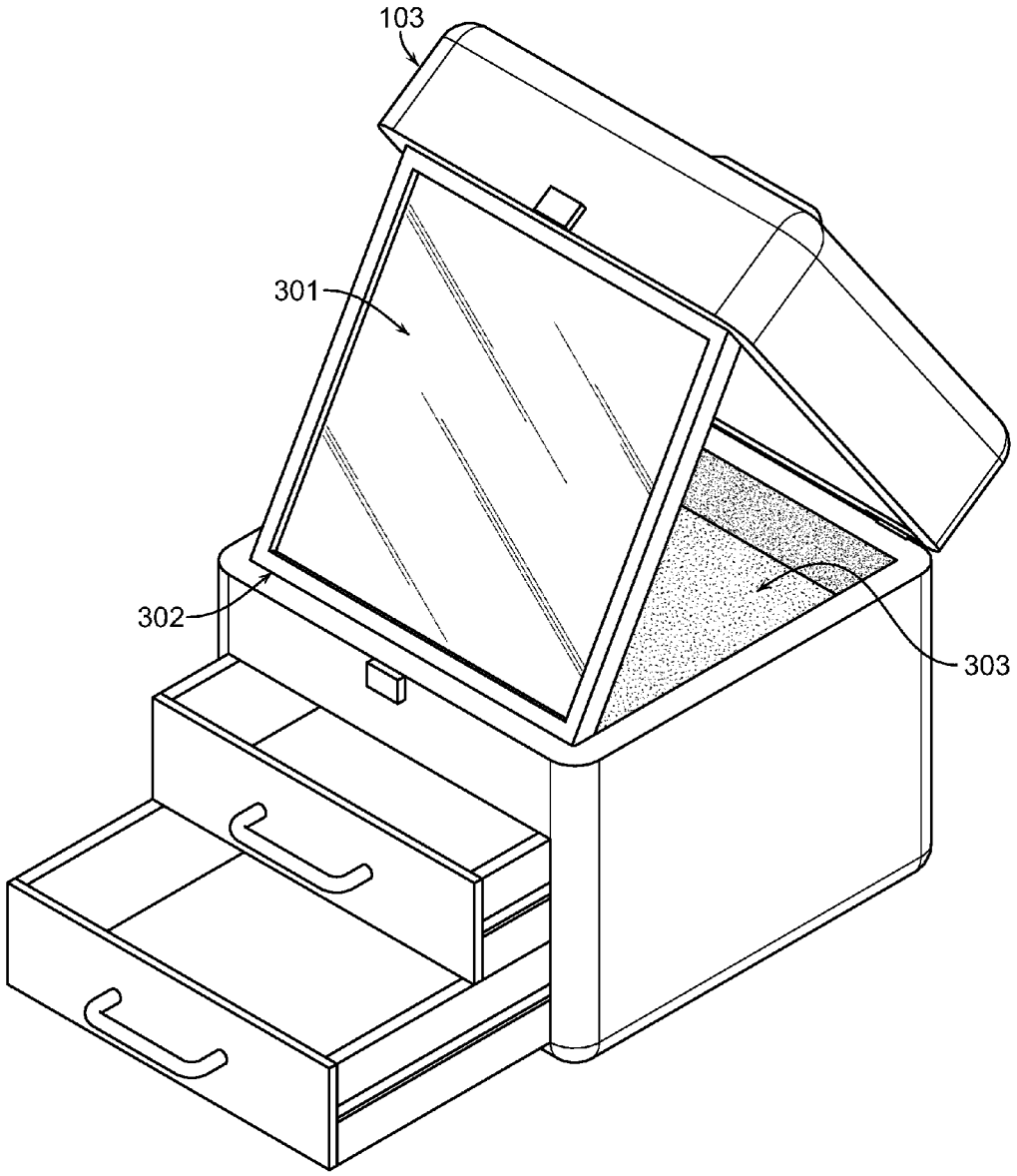

FIG. 3 shows the exterior of the box as it appears while in use. The lid (103) has been lifted to display the mirror (301). In its open position, the mirror is propped essentially upright. For example, it may be propped up against the upper-front edge (302) of the box. In its closed position, the mirror lies between the lid (103) and the top of the upper surface (303) of the box.

Figure 4:
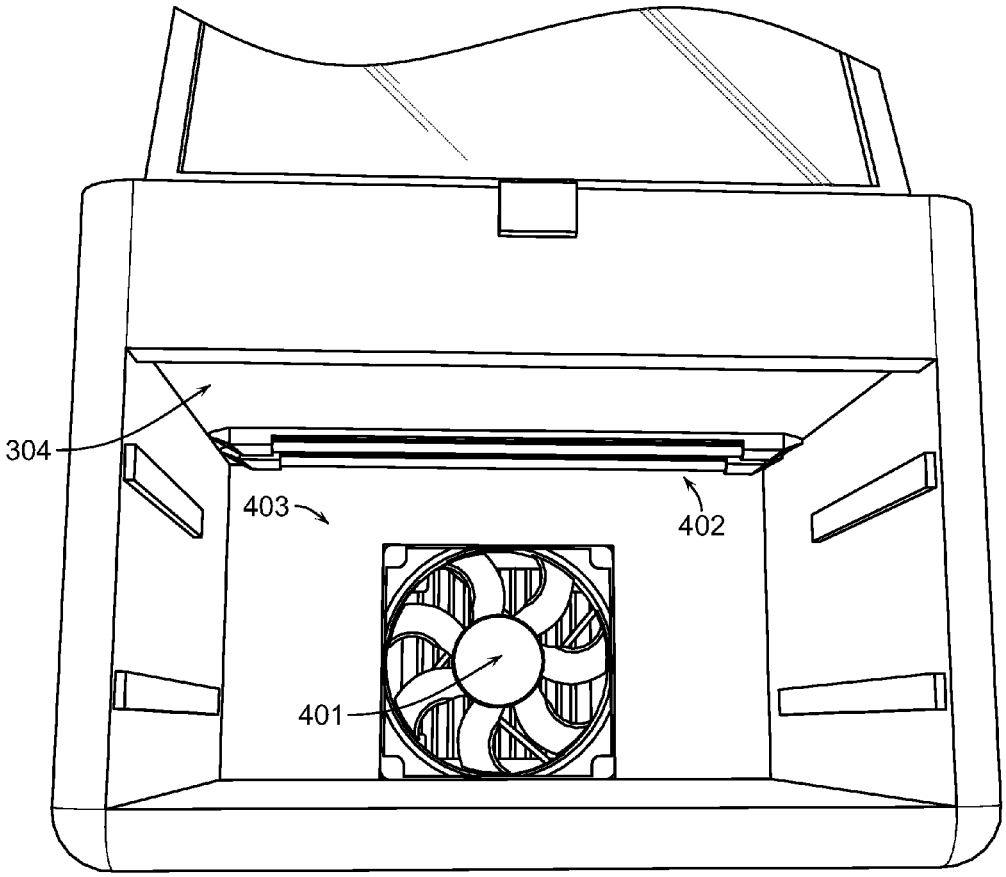

FIG. 4 shows the clearest view of the fan (401) and the UV bulbs (402). The fan is mounted within the rear face (403) of the box. The fan blows air in the direction of the box's interior. The UV bulbs (402) are mounted on the underside of the upper surface (304) of the box. While the figures show exactly two UV bulbs, there may be any number of them. In FIG. 4, the drawer is removed so that the details of the interior may be seen clearly. In this open configuration, the user would be able to insert her hands into the box for drying by the fan and/or UV bulbs.

The rear face of each drawer is made of netting (104). When the drawers are pulled ajar and the fan is turned on, air (701) from the fan flows easily through the netting and drawer cavity, and is then directed upward toward the user's face.

Figure 8:
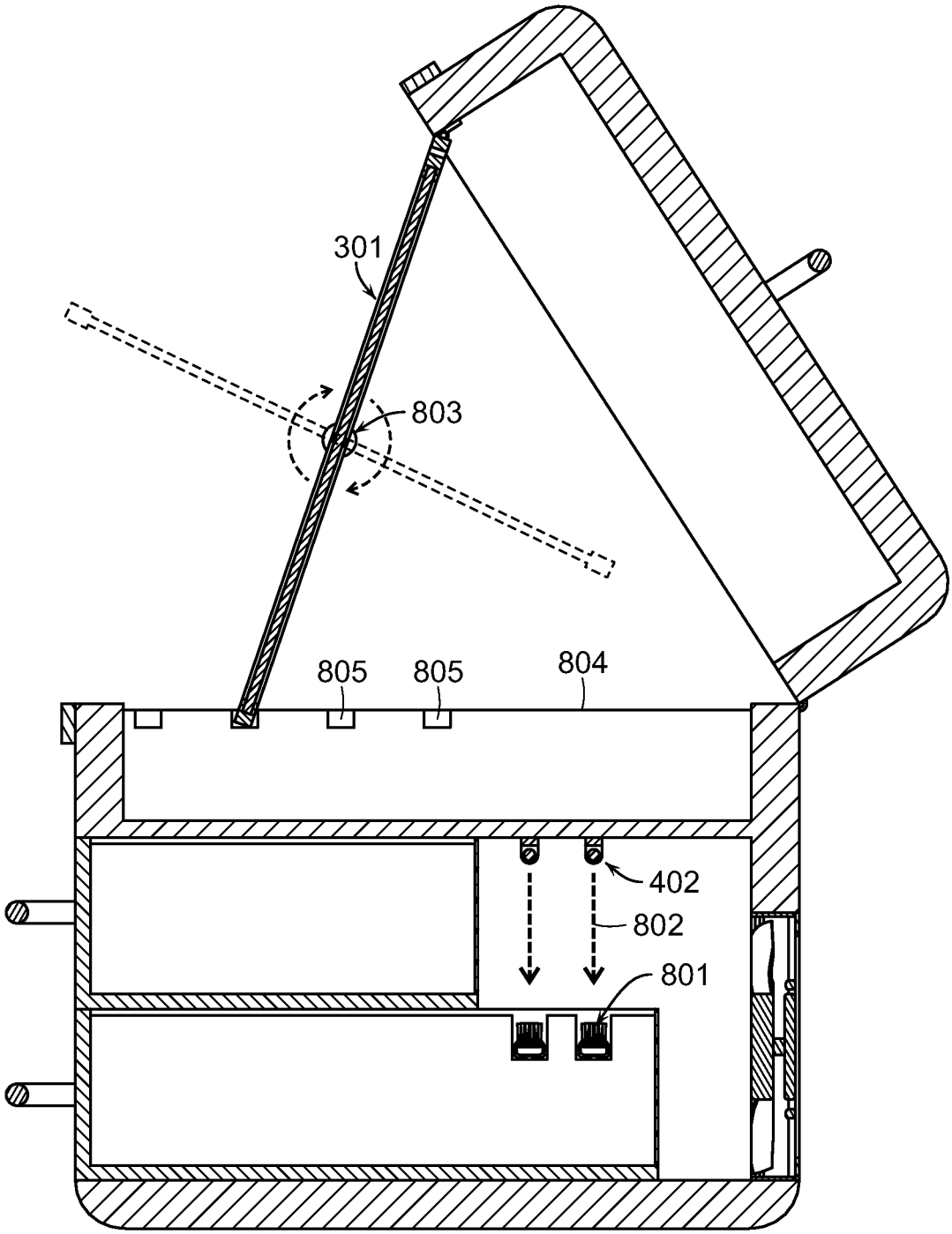
FIG. 8 is a side plan view of the box with the lid open. This figure shows the optional features of a swiveling mirror with adjustment notches.

When the drawer is inserted, the UV bulbs may be left on to sterilize the contents (801) of the drawer. These contents can include exposed surfaces of makeup, sponges and brushes, nail files, tooth brushes, and other products that must be kept free of infection. FIG. 8 shows UV light (802) from the UV bulbs (402) sterilizing contents (801).

Figure 5:
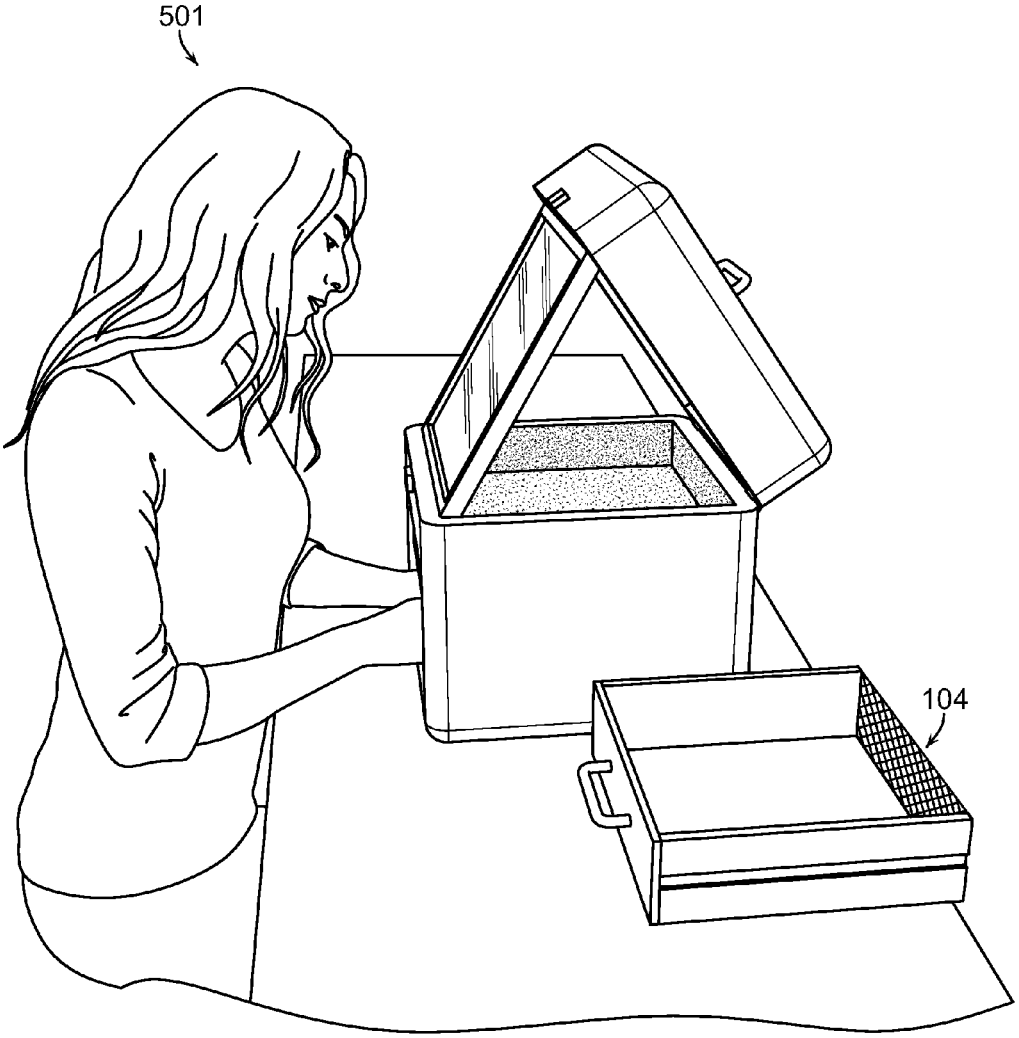

FIG. 5 shows a user (501) using the cosmetic box to dry her makeup. This figure shows how the user can look directly into the mirror while receiving a draft of air from the drawer cavities. She is also very easily able to insert her hands into the interior of the box to dry and sterilize her fingernails.

FIGS. 6-9 show optional features of the cosmetic box.

Figure 6:
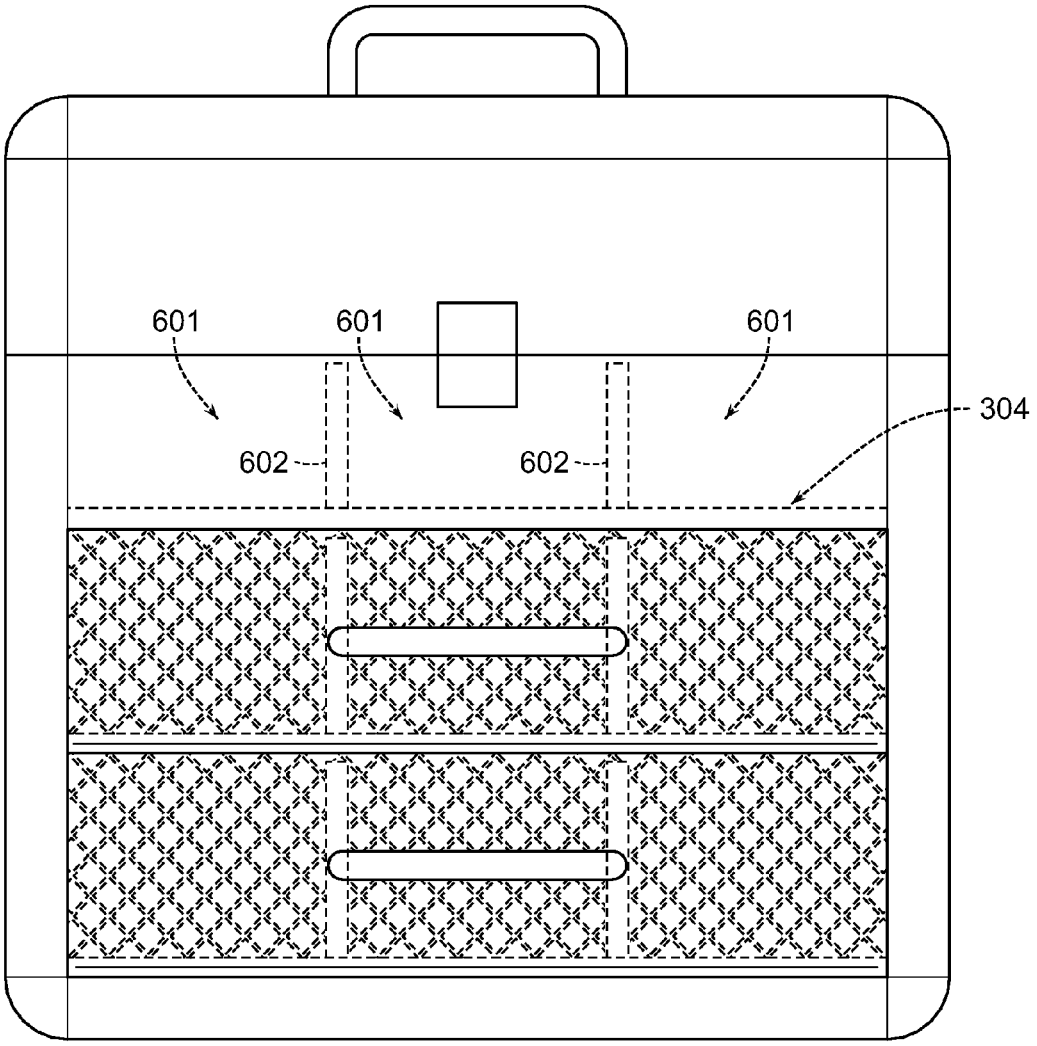
Figure 7:
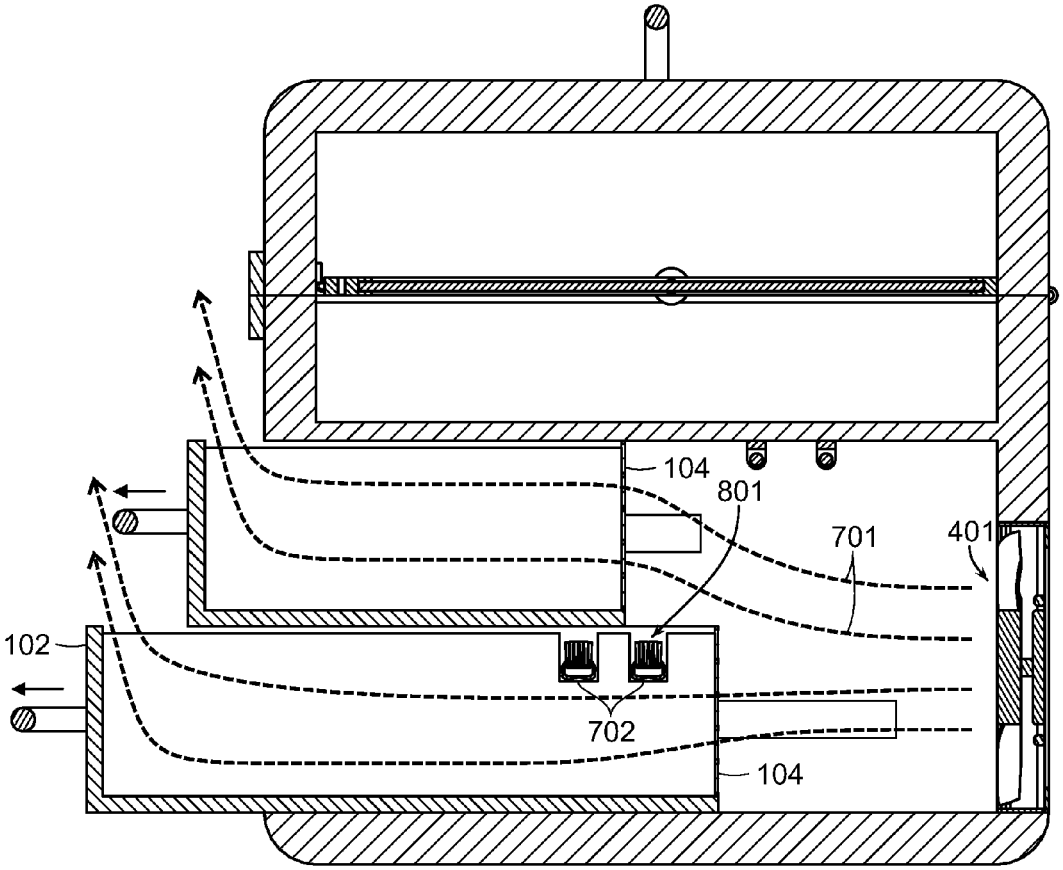
FIG. 7 is a side plan view of the box's interior, showing the flow of air from the fan through the drawers. This figure shows the optional feature of storage grooves in one drawer.
Figure 9:
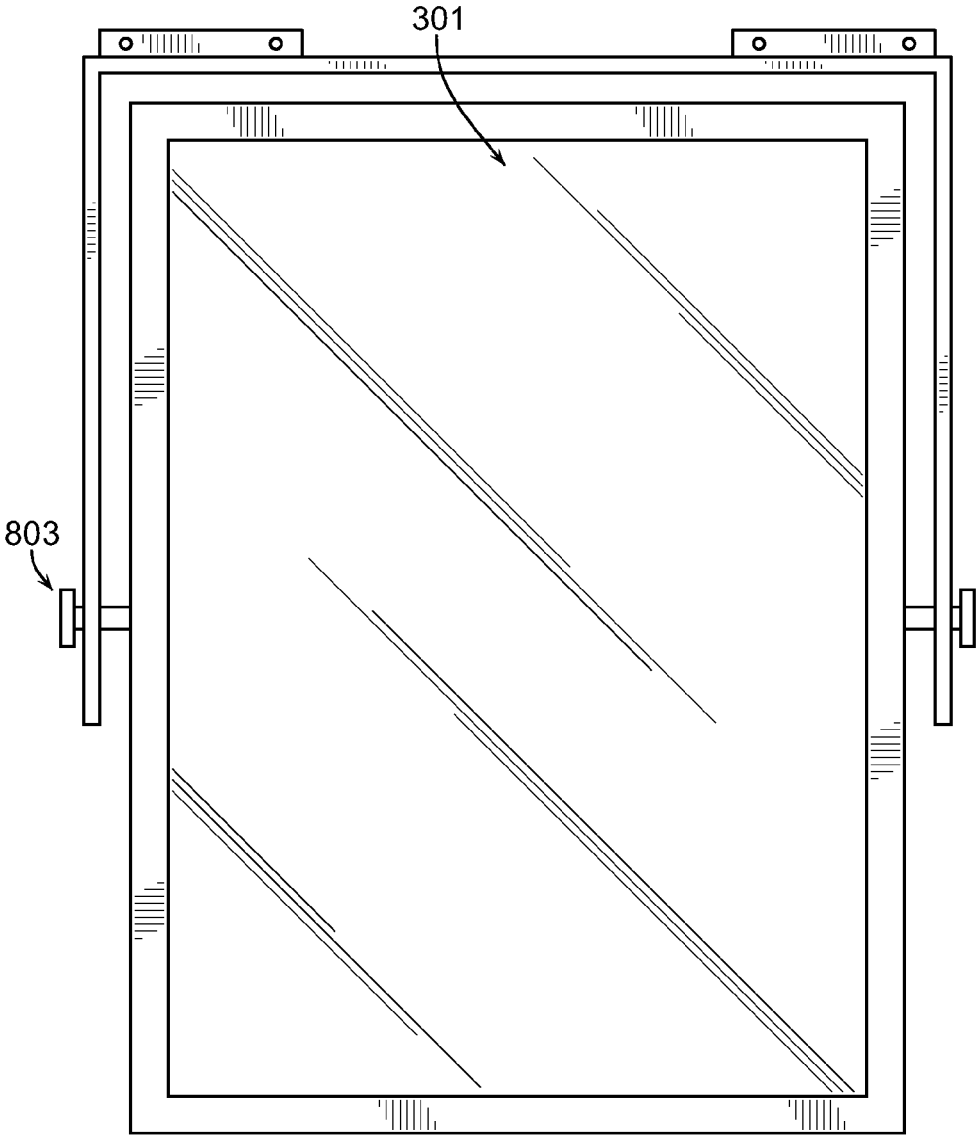
FIG. 9 is a front plan view of the mirror with optional swiveling means.

In FIG. 6, each drawer and the upper surface (303) are divided into compartments (601) by dividers (602). In FIG. 7, the dividers of at least one drawer include grooves (702) to hold small contents (801) in the drawer. In FIG. 8, the mirror (301) can be swiveled about swiveling means (803) so that the user (501) can use two faces of the mirror. In best use, one face of the mirror would be flat and the other face would be magnifying. The left and right upper edges (804) of the box may be cut with notches (805) to prop up the mirror at different angles. FIG. 9 is a closer view of the mirror (301) with the optional swivel means (803).

Though not shown in the figures, the box includes the electric apparatus necessary to power the fan and lights.

We claim:

1. A cosmetic box with make-up drying apparatus, comprising:

a cosmetic box essentially in the shape of a rectangular prism, with upper, lower, left, right, front, and rear faces, an upper left edge at the intersection of the upper face and the left face, an upper right edge at the intersection of the upper face and the right face, and an upper rear edge at the intersection of the upper face and the rear face;

a lid hingedly attached to the upper rear edge of the cosmetic box, the lid having a front edge that is adjacent to the front face of the cosmetic box when the lid is closed;

a mirror hingedly attached to the front edge of the lid, the mirror supported on the upper face of the cosmetic box when the lid is open;

at least one drawer in the front face of the cosmetic box, each drawer having a rear face that is juxtaposed with the rear face of the cosmetic box when the drawer is closed;

air-permeable netting at the rear face of each drawer;

a fan mounted in the interior of the cosmetic box; and ultra-violet (UV) light bulbs mounted in the interior of the cosmetic box.

2. The cosmetic box with make-up drying apparatus described in claim 1, also including vertical dividers in at least one drawer or on the top of the upper surface of the cosmetic box, said dividers dividing the drawer or the upper surface into compartments.

3. The cosmetic box with make-up drying apparatus described in claim 2, wherein the dividers of at least one drawer are cut with grooves for the storage of small contents.

4. A cosmetic box with make-up drying apparatus, comprising:

a cosmetic box essentially in the shape of a rectangular prism, with upper, lower, left, right, front, and rear faces, an upper left edge at the intersection of the upper face and the left face, an upper right edge at the intersection of the upper face and the right face, and an upper rear edge at the intersection of the upper face and the rear face;

a lid hingedly attached to the upper rear edge of the cosmetic box, the lid having a front edge that is adjacent to the front face of the cosmetic box when the lid is closed;

a mirror hingedly attached to the front edge of the lid, the mirror supported on the upper face of the cosmetic box when the lid is open;

at least one drawer in the front face of the cosmetic box, each drawer having a rear face that is juxtaposed with the rear face of the cosmetic box when the drawer is closed;

air-permeable netting at the rear face of each drawer;

a fan mounted in the interior of the cosmetic box;

ultra-violet (UV) light bulbs mounted in the interior of the cosmetic box;

a magnifying face on one side of the mirror; and swiveling means allowing the user to select either face of the mirror.

5. The cosmetic box with make-up drying apparatus described in claim 1, wherein the supporting means for the mirror comprise two or more notches cut into the upper edges of the cosmetic box.

* * * * *